United States Patent [19]

Phillips, Jr.

[11] Patent Number: 4,738,359

[45] Date of Patent: Apr. 19, 1988

[54] CIGARETTE CARTON ASSEMBLY

[75] Inventor: Floyd L. Phillips, Jr., Winston-Salem, N.C.

[73] Assignee: R. J. Reynolds Tobacco Company, Winston-Salem, N.C.

[21] Appl. No.: 81,079

[22] Filed: Aug. 3, 1987

[51] Int. Cl.[4] ..... B65D 85/10

[52] U.S. Cl. ..... 206/256; 206/273

[58] Field of Search ..... 206/273, 491, 602, 256; 229/87 C

[56] References Cited

U.S. PATENT DOCUMENTS

| | | | |
|---|---|---|---|
| 2,605,897 | 8/1952 | Rundle | 206/273 X |
| 2,895,601 | 7/1959 | Krukonis | 206/45.31 |
| 3,071,244 | 1/1963 | Doran | 206/273 X |
| 3,082,929 | 3/1963 | Aquino et al. | 206/602 X |
| 3,086,650 | 4/1963 | Chapman et al. | 206/245 X |
| 3,113,673 | 12/1963 | Stein | 206/602 |
| 3,163,351 | 12/1964 | Borgardt | 206/602 |
| 3,536,246 | 10/1970 | Rosen | 206/256 X |
| 3,596,758 | 8/1971 | Phillips, Jr. | 206/273 X |
| 3,721,335 | 3/1973 | Grant | 206/256 |
| 3,752,308 | 8/1973 | Begemann | 206/273 X |
| 4,631,900 | 12/1986 | Mattei et al. | 53/449 X |

OTHER PUBLICATIONS

*Modern Packaging,* 5-Pack Cigarettes, (1947).

*Primary Examiner*—William Price

[57] ABSTRACT

A conventional master carton for 10 packages of cigarettes contains two half cartons of 5 packages each therein. The half cartons are removable from the master carton and can be handled for sale. The half cartons have an open top such that the packages therein can be tax stamped while within the master carton using conventional automated tax marking apparatus.

4 Claims, 4 Drawing Sheets

CIGARETTE CARTON ASSEMBLY

BACKGROUND OF THE INVENTION

The present invention relates to the packaging of smoking articles such as cigarettes into cartons, and in particular to the packing of packages of cigarettes into cartons such that the individual packages can be readily tax stamped.

It is common practice to ship and store cigarette packages in cartons. Conventional cigarette cartons ordinarily hold ten packages, each package containing about 20 cigarettes. The packages are usually arranged in two relatively superposed rows of 5 packages each. Such standard cartons completely encase the cigarette packages and are provided with glued flaps. An example of a carton for ten packages of cigarettes is described in U.S. Pat. No. 3,752,308 to Begemann.

Individual jurisdictions require the application of a tax stamp to each package of cigarettes sold in the respective jurisdiction. Typically, the distributor or jobber in the jurisdiction receives the cartons from the manufacturer, unseals the flap of carton which is sealed with a fugitive adhesive, applies the tax stamp to each package of cigarettes, and then recloses and reseals the carton. In order to minimize the time, labor and expense associated with tax stamping of the packages within the carton, various automated tax marking or stamping machines have been developed. Such tax marking machines automatically print or otherwise affix tax stamps to packages within the carton. Tax stamping machines which are most commonly employed by distributors and jobbers include ADCO Automatic Heat Transfer Decalomanic Stamping Machine which is available from American Decal & Mfg. Co., Chicago, Ill.; Cigarette Tax Stamp Applying Machine which is available from Meyercord, Carol Stream, Ill.; and Cigarette Tax Stamping Machine which is available from Pitney Bowes, Stamford, Conn. Accordingly, the dimensions and construction of the standard cigarette carton have been established by the tax stamping machinery customarily employed by the distributors, wholesalers and jobbers who tax mark the cigarette packages prior to retail sale.

A manufacturer desiring to provide cigarettes in non-standard size or shape cartons is forced to pay to have the individual packages hand tax stamped. However, a manual method for providing non-standard size or shape cartons of packaged cigarettes is time consuming, laborious and expensive. As disclosed in *Modern Packaging* (1947), half carton packs are provided using a three sided paperboard collar and cellophane wrap such that the bottom of the cigarette packages are exposed for tax stamping. Another method for packaging cigarette packages into cartons which are divisible into smaller units is proposed in U.S. Pat. No. 4,631,900 to Mattei et al.

Occasionally, manufacturers desire to market cartons containing five packages of cigarettes. However, such cartons have not achieved any appreciable commercial success. In particular, five package cartons having a configuration comparable to standard cigarette cartons have had a top flap configuration. The top flap has required that the packages of such cartons be tax stamped by hand or that the tax stamped packages be manually loaded in the carton.

It would be desirable to provide a manner or method for efficiently and effectively packaging cigarettes in divisible cartons (eg., half cartons) which in turn are contained within standard cartons. In particular, it would be desirable for the manufacturer to efficiently and effectively provide cigarette packages contained in half cartons which in turn are contained within standard cartons for tax stamping using conventional automatic or semi-automatic tax stamping machinery.

SUMMARY OF THE INVENTION

This invention relates to a carton assembly for ten packages of smoking articles which are arranged therein for transport through and marking using a tax marking apparatus designed for tax marking the packages arranged within the standard size carton. The carton assembly includes a standard size master carton containing two removable half cartons which each contain five packages of smoking articles.

The half cartons each are formed from a single blank of material having portions thereof defining carton end wall structure at opposite ends of the carton, a pair of carton side walls, and a carton bottom wall. The portions of the blank are joined along fold lines therein. The half carton is erected by folding the blank along the fold lines to form an elongated box-like enclosure having an open top.

The present invention provides the manufacturer of smoking article such as cigarettes with a method for packaging its product in cartons which can be tax marked (eg., using prints, decals, or the like) using conventional tax marking apparatus. Of particular interest is the fact that the divisible half cartons can be packaged by the manufacturer, passed through tax stamping operations, and delivered to the retailer or consumer. In addition, the individual packages can be packaged within the carton assembly using a relatively simple one-step packaging process using equipment which can be operated with relative ease.

DETAILED DESCRIPTION OF THE PREFERRED EMBODIMENTS

Figure 1:
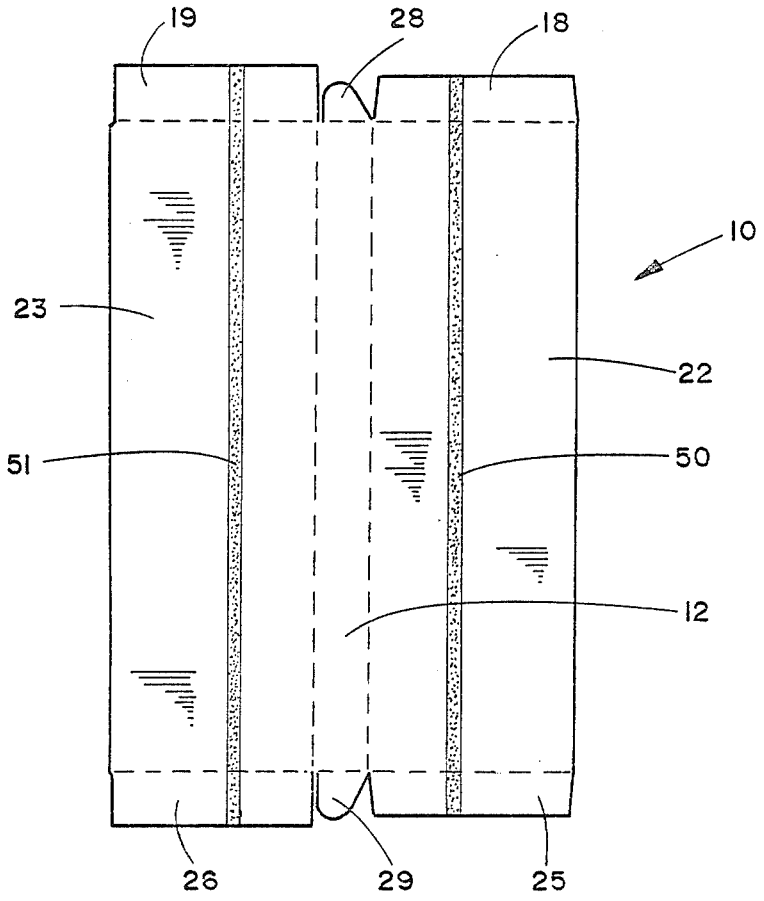
FIG. 1 is a top plan view of the blank from which the half carton is formed.

Referring to FIG. 1, carton blank 10 is of a construction generally similar to the standard carton. The blank 10 is preferably manufactured from paperboard, although other suitable materials such as paper, plastic, or the like can be employed. The blank includes portion 12 corresponding to the bottom of the carton; a pair of end wall parts 18 and 19, respectively, each positioned at one end of the blank and integral with the respective side wall parts 22 and 23; and another pair of end wall parts 25 and 26 respectively, each positioned at the end of the blank opposite end wall parts 18 and 19, respectively, and integral with the respective side wall parts 22 and 23. The end wall parts 18, 19 and 25, 26 together form the end wall structure at opposite ends of the carton box-like enclosure. The blank further includes optional reinforcing tabs or "dust flaps" 28 and 29 at opposite ends of the carton and integral with the carton bottom 12. The manner of erecting the carton from the blank 10 is understood by those skilled in the art and involves the folding of the blank parts along the fold lines (shown in FIG. 1 as dashed lines) to form the box-like enclosure with the open top and with the overlapping and securement together of the end wall parts 18, 19 and 25, 26 being done in conventional manner employing to that end a suitable adhesive to hold the overlapping parts secured.

Figure 2:
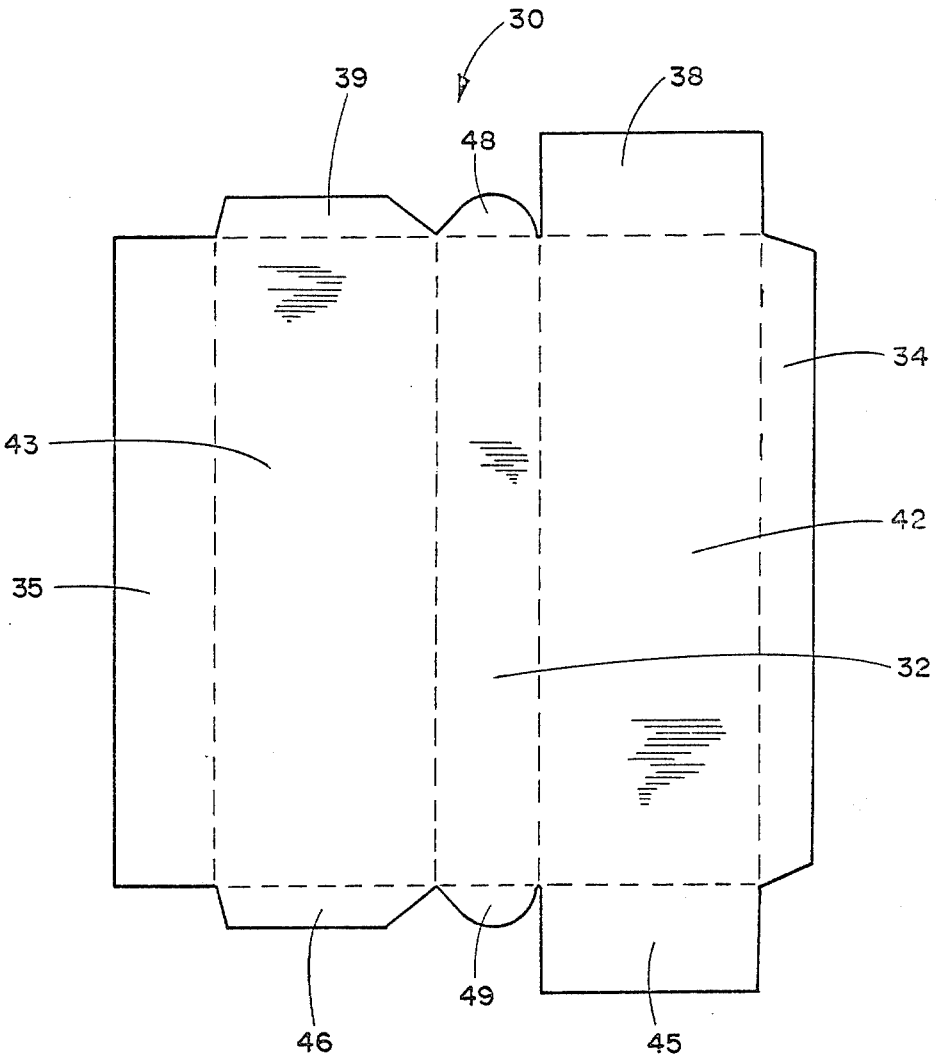
FIG. 2 is a top plan view of the blank from which the standard or master carton is formed.

Referring to FIG. 2, carton blank 30 is of a construction generally similar to a conventional standard carton. The blank 30 preferably is manufactured from materials conventionally used in manufacturing cigarette cartons. The blank includes portion 32 corresponding to the bottom of the carton; a pair of flaps 34 and 35 which overlappingly fold together when the carton is erected to comprise the top of the carton; a pair of end wall parts 38 and 39, respectively, each positioned at one end of the blank and integral with the respective side wall parts 42 and 43; and another pair of end wall parts 45 and 46 respectively, each positioned at the end of the blank opposite end wall parts 38 and 39, respectively, and integral with the respective side wall parts 42 and 43. The end wall parts 38, 39 and 45, 46 together form the end wall structure at opposite ends of the carton box-like enclosure. The blank preferably includes reinforcing tabs 48 and 49 at opposite ends of the carton and integral with the carton bottom 32. The manner of erecting the master carton from the blank 30 is understood by those skilled in the art and involves the folding of the blank parts along the fold lines (shown in FIG. 2 as dashed lines) to form the box-like enclosure with the open top and with the overlapping and securement together of the end wall parts 38, 39 and 45, 46 being done in conventional manner employing to that end a suitable adhesive to hold the overlapping parts secured.

Optionally, one or more stripes of tacky adhesive 50 and 51 can be applied to the inner surface of at least one of the side walls 22 and 23. The tacky adhesive allows the packages to remain securely positioned and maintained within the half carton during handling while allowing for each individual package to be easily removed from the half carton for use.

Figure 3:
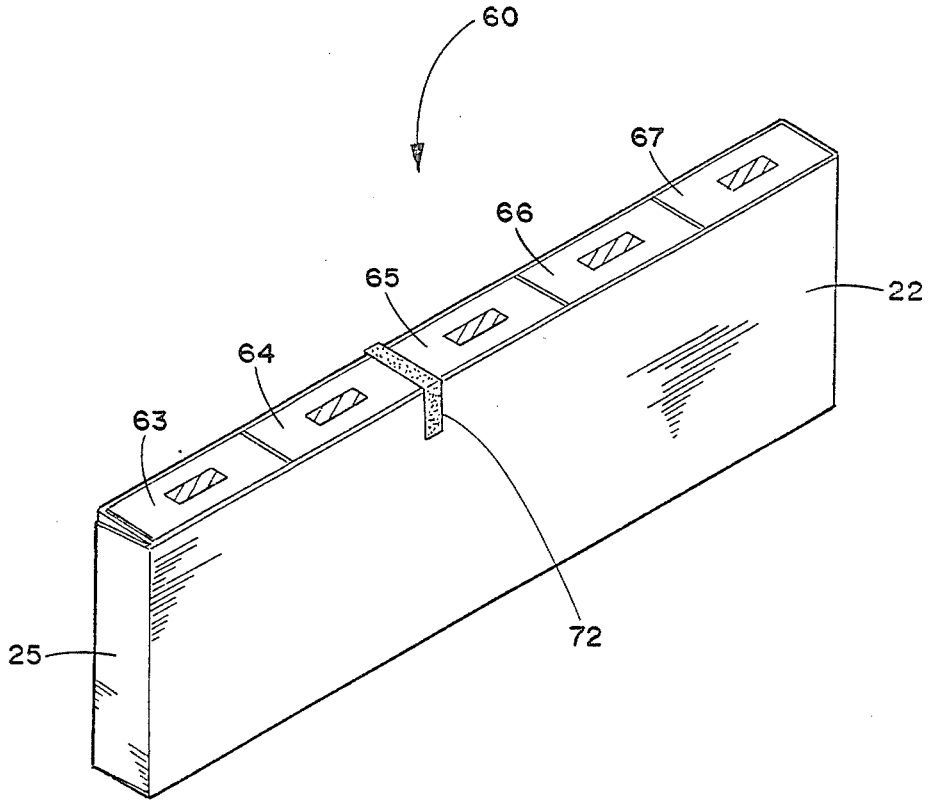
FIG. 3 is a perspective of a half carton containing five packages of cigarettes.

The blank 10 shown in FIG. 1 is erected to form a half carton 60 which is illustrated in FIG. 3. Half carton 60 is filled with five cigarette packages 63, 64, 65, 66 and 67 which are positioned upright and in end-to-end alignment. The carton 60 is an elongated enclosure structure having side 22 and exposed wall end part 25.

Optionally, one or more thin strips of tape 72 can extend over the open top of the half carton in a region where adjacent packages abut one another. The tape assists in allowing the packages to remain securely positioned and maintained within the half carton during handling. The tape 72 which is manufactured from polypropylene, or the like, can be easily broken in order to allow each individual package to be easily removed from the half carton for use.

Figure 4:
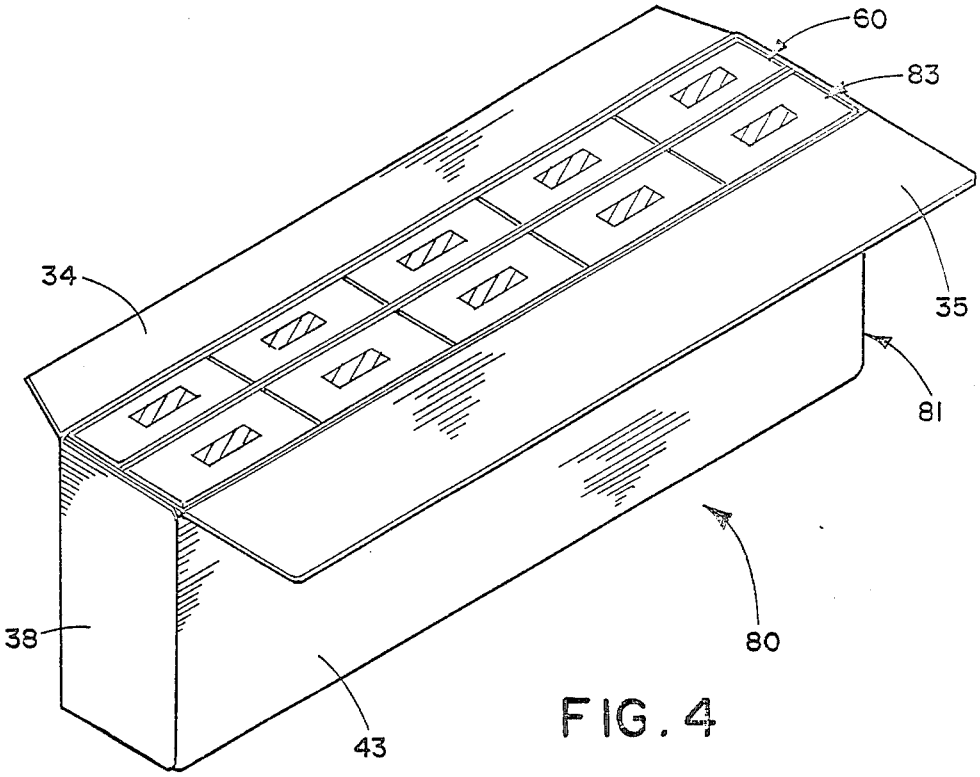
FIG. 4 is a perspective of a standard carton containing two half cartons wherein each half carton contains five packages of cigarettes.

Referring to FIG. 4, carton assembly 80 includes master carton 81. In particular, the blank 30 shown in FIG. 2 is erected to form a master carton 81. The master carton 81 contains half carton 60 and a second half carton 83, each of which are positioned side by side such that the cigarette packages within the half cartons are arranged in two coextensive rows with the packages in each row extending in side-by-side alignment and being paired with a corresponding package in the other row of the corresponding half carton. The master carton 81 is an elongated enclosure structure having side 42 and exposed wall end part 45. The top flaps 34 and 35 are shown in FIG. 4 such that the master carton is in the open position. The flaps can be folded over and sealed to close the top of the master carton. The half cartons generally are held in place within the master carton by friction fit.

As used herein, the term "package" means a package comparable in size and shape to a conventional cigarette package which contains 20 cigarettes. See, for example, U.S. Pat. No. Des. 279,507 to Schechter et al. The package can be a soft package or a crush proof box. Generally, a package has a height of about 70 mm to about 100 mm, and most frequently 20 rod-shaped smoking articles each having a circumference of about 22 mm to about 25 mm are arranged therein in a so called "7-6-7" configuration.

As used herein, the term "standard size carton" means a conventional carton which is capable of containing 2 rows of 5 cigarette packages, and which most preferably is capable of being passed through commonly employed automated tax stamping apparatus. Generally, the length of a standard carton is a minimum of about 266 mm and a maximum of about 286 mm. Generally, the width of a standard carton ranges from about 40 mm to about 50 mm. Generally, the height of a standard carton (when the top flaps are positioned such that the carton is in a closed configuration) ranges from about 70 mm to about 100 mm.

An example of a preferred embodiment of this invention is as follows. A standard carton has a length of about 270 mm, height of about 101 mm, width of 45 mm; and contains 10 packages of 20 cigarettes. The packages are arranged in a 1 by 5 fashion within each of the two half cartons, which are in turn positioned within the standard carton. The three cartons are manufactured from paperboard having a thickness of about 0.25 mm to about 0.30 mm.

Figure 5:
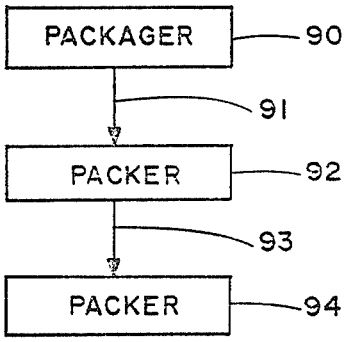
FIG. 5 is a schematic diagram illustrating the manner in which the half cartons are packed with cigarette packages and in turn packaged within the master carton.

Referring to FIG. 5, packages of cigarettes are provided from packaging unit 90 such as any conventional apparatus for packaging smoking articles such as cigarettes. Suitable packaging units and the operation thereof will be apparent to the skilled artisan. The individual packages are transferred via conveyor 91 or other suitable transfer means to packing unit 92. Packing unit 92 is known in the industry as a Molins Boxer and is commercially available from Molins PLC, Great Britain. Packing unit 92 is suitably modified to provide a series of half cartons each containing one row five packages. The modification to the packing unit 92 as well as the operation thereof will be apparent to the skilled artisan. The half packages are transferred via conveyor 93 or other suitable transfer means to second packing unit 94. Packing unit 94 is any conventional packing unit such as a Molins Boxer which has been modified so as to have the two half cartons inserted therein, and thus provide a master carton containing two half cartons. The half cartons are positioned within the master carton such that the open top of the half cartons are exposed when the top flaps of the master carton are opened. The resulting master cartons then are transferred for further handling for shipping, etc.

Other methods for assembling the carton assemblies will be apparent to the skilled artisan.

The cigarette packages within the carton configuration of this invention can be tax stamped using conventional tax stamping apparatus. The flaps of the master carton can be opened, the top (i.e., exposed) side of each of the cigarette packages can be stamped, and the master carton sealed, all without the necessity of removing or rearranging the cigarette packages. Thus, the half cartons (i.e., cartons which contain 5 packages of smoking articles) can be handled and processed by the jobber or wholesaler as are conventional cartons containing 10 packages of smoking articles. When the master carton is opened for retail sale, the two half cartons can be removed from the master carton and handled as such. Thus, the cigarette manufacturer can efficiently and effectively provide an inexpensive multi-pack unit of smoking articles for sale. Additionally, the manufacturer can easily provide a means for displaying and merchandising unique multi-pack units of its products.

What is claimed is:

1. A carton assembly for ten packages of smoking articles which are arranged within the carton assembly for transport through and marking using a tax marking apparatus designed for tax marking the packages arranged within a standard size carton, the carton assembly comprising:

(i) a standard size master carton formed from a single blank of material having portions thereof defining carton end wall structure at opposite ends of the carton, a pair of carton side walls, a carton bottom wall and carton top wall structure formed by two flaps; the portions being joined along fold lines in the blank with the blank being erected by folding the blank along the fold lines to form an elongated box-like enclosure; and (ii) two half cartons which are contained within and removable from the master carton, (a) each half carton containing five packages of smoking articles and (b) each half carton formed from a single blank of material having portions thereof defining carton end wall structure at opposite ends of the carton, a pair of carton side walls, a carton bottom wall; the portions being joined along fold lines in the blank with the blank being erected by folding the blank along the fold lines to form an elongated box-like enclosure having an open top.

2. The carton assembly of claim 1 wherein the standard size carton and the two half cartons are each manufactured from paperboard.

3. The carton assembly of claim 1 wherein the half cartons each comprise at least one stripe of adhesive applied to the inner surface of at least one of the side walls thereof in order to provide for secure positioning of the packages within the half carton.

4. The carton assembly of claim 1 containing ten packages of cigarettes.

* * * * *